US011981403B1

(12) United States Patent
Liu et al.

(10) Patent No.: US 11,981,403 B1
(45) Date of Patent: May 14, 2024

(54) METHOD AND DEVICE FOR AUTOMATIC DETECTION OF VESSEL DRAFT DEPTH

(71) Applicant: Wuhan University of Technology, Wuhan (CN)

(72) Inventors: Wen Liu, Wuhan (CN); Jingxiang Qu, Wuhan (CN); Chenjie Zhao, Wuhan (CN); Yang Zhang, Wuhan (CN); Yu Guo, Wuhan (CN)

(73) Assignee: Wuhan University of Technology, Wuhan (CN)

( * ) Notice: Subject to any disclaimer, the term of this patent is extended or adjusted under 35 U.S.C. 154(b) by 0 days.

(21) Appl. No.: 18/507,057

(22) Filed: Nov. 12, 2023

(30) Foreign Application Priority Data

Jun. 5, 2023 (CN) ..... 202310655189.7

(51) Int. Cl.
*B63B 39/12* (2006.01)

(52) U.S. Cl.
CPC ..... *B63B 39/12* (2013.01)

(58) Field of Classification Search
CPC ..... B63B 39/12
See application file for complete search history.

(56) References Cited

FOREIGN PATENT DOCUMENTS

CN 110033481 A * 7/2019 ..... G06K 9/6267
CN 114066964 A * 2/2022
CN 114972793 A * 8/2022
WO WO-2020049702 A1 * 3/2020
WO WO-2020151149 A1 * 7/2020
WO WO-2023081978 A1 * 5/2023

OTHER PUBLICATIONS

Wei, Yaoming. "Research Review of Ship Draft Observation Methods." American Journal of Traffic and Transportation Engineering 8.2 (2023): 33.*
Zhang Gangqiang et al., Research on recognition method of ship water gauge reading based on improved UNet network, Journal of Optoelectronics Laser, Nov. 2020, pp. 1182-1196, vol. 31, No. 11.
CNIPA, Notification of First Office Action for CN202310655189.7, dated Jul. 10, 2023.
Wuhan University of Technology (Applicant), Reply to Notification of First Office Action for CN202310655189.7, w/ replacement claims, dated Jul. 14, 2023.
Wuhan University of Technology (Applicant), Supplemental Reply to Notification of First Office Action for CN202310655189.7, w/ (allowed) replacement claims, dated Jul. 18, 2023.
CNIPA, Notification to grant patent right for invention in CN202310655189.7, dated Jul. 27, 2023.

* cited by examiner

*Primary Examiner* — Herbert K Roberts

(57) ABSTRACT

Disclosed is a method and device for automatic detection of vessel draft depth, which processes the image of a vessel's hull and extracts local area image blocks with vessel's water gauge scale separately to improve the pertinence of data processing and reduce the complexity of data processing; and based on a multi-task learning network model, performing data processing on local area image blocks to extract scale characters and waterline position, reducing the computational complexity of the model; finally, based on the relative positions of the scale and waterline, determining the vessel's draft depth, thus achieving automatic acquisition of the vessel's draft depth, this method greatly improves the efficiency of reading the vessel's draft depth.

8 Claims, 6 Drawing Sheets

METHOD AND DEVICE FOR AUTOMATIC DETECTION OF VESSEL DRAFT DEPTH

FIELD OF THE DISCLOSURE

The disclosure relates to the technical field of image recognition and processing, in particular to a method and device for automatic detection of vessel draft depth.

BACKGROUND

With the continuous expansion of China's maritime demand, inland river transportation has become one of the mainstream channels of trade, and the requirements for the supervision efficiency of water transportation system are also increasing. In daily supervision, the draft depth of vessels is an important object monitored by the maritime department.

For the issue of how to detect the draft depth of vessels, there are detection methods based on acoustic signals and visual images. Among them, draft depth detection method based on acoustic signals is to install the acoustic signal transmitters and receivers on both sides of the channel, use the reception of the acoustic signal, and combine the current water surface height to determine the vessel's draft depth. The equipment deployment cost is high and requires manual reading of water surface height. The deployment of equipment based on visual images is simpler, but it often requires manual reading. Currently, existing automatic reading methods based on visual images require high accuracy in water gauge scale recognition and waterline detection, and are affected by vessel fouling.

Therefore, in the process of obtaining vessel draft depth in existing technologies, there is a problem of relying too much on manual labor, resulting in low reading efficiency.

SUMMARY

The purpose of this disclosure is to provide a method and device for automatic detection of vessel draft depth to solve the problem of low reading efficiency caused by excessive reliance on manual labor in the process of obtaining vessel draft in existing technologies.

This disclosure provides a method for automatic detection of vessel draft depth, comprising:

obtaining a hull image of a vessel;

based on a target image recognition network model, performing image recognition on the hull image of the vessel to obtain local area image blocks, where the local area image blocks include the vessel's water gauge scale;

constructing a multi-task learning network model, the multi-task learning network model includes a multi-scale convolutional neural network, a target detection sub network, and a water surface and vessel hull segmentation sub network;

performing feature extraction of local area image blocks based on multi-scale convolutional neural networks to obtain image features of the local area image blocks;

based on a target detection sub network, performing target classification, target box position prediction, and background judgment on image features to determine scale characters;

based on a sub network of water surface and hull segmentation, performing target extraction on the image features to determine the position of the waterline;

determining whether only a first available scale is included in the available scales;

if so, determining the vessel's draft depth using a first draft depth calculation formula based on the first available scale, the distance between the first available scale and the water surface, and the character height;

if not, determining whether the available scales include a second available scale and a third available scale;

if the third available scale is not included in the available scales, then based on the first available scale, the second available scale, the distance between the available scale and the water surface, and the distance between the available scales, determining the vessel's draft depth by a second draft depth calculation formula;

if the available scales include the second available scale and the third available scale, then based on the first available scale, the second available scale, the third available scale, the distance between the available scale and the water surface, and the distance between the available scales, determining the vessel's draft depth using a third draft depth calculation formula;

wherein the first draft depth calculation formula is:

$$D = S_1 - \frac{\beta \cdot d}{h_1}$$

where, D is the vessel's draft depth, $S_1$ is the first available scale, β is the character height, d is the distance between the first available scale and the water surface, and $h_1$ is the height of the detection box corresponding to the scale;

the second draft depth calculation formula is:

$$D = \frac{d}{d_1}(S_1 - S_2)$$

where, $d_1$ is the distance between the first available scale and the second available scale, and $S_2$ is the second available scale;

the third draft depth calculation formula is:

$$D = \frac{d_2 \cdot d \cdot (S_2 - S_1)}{d_1 \cdot d_1 \cdot (S_3 - S_2)}$$

where, $d_2$ is the distance between the second available scale and the third available scale, $S_3$ and is the third available scale.

This disclosure also provides a device for automatic detection of vessel draft depth, comprising:

a vessel hull image acquisition module, which is used for obtaining vessel hull image;

a local area image blocks acquisition module, which is used for image recognition of a vessel hull image based on a target image recognition network model to obtain local area image blocks, wherein the local area image blocks include the vessel water gauge scale of the vessel hull image;

a multi-task learning network model construction module, which is used for constructing a multi-task learning network model, the multi-task learning network model includes a multi-scale convolutional neural network, a target detection sub network, and a water surface and vessel hull segmentation sub network;

an image feature extraction module, which is used for extracting features from the local area image block based on the multi-scale convolutional neural network, and obtaining image features of the local area image blocks;

a scale character determination module, which is used for target classification, target box position prediction, and background judgment of the image features based on the target detection sub network to determine scale characters, wherein the scale characters include available scale, distance between available scale and water surface, available scale spacing, and character height;

a waterline position determination module, which is used to extract targets from the image features based on the water surface and ship hull segmentation sub network, and determine the waterline position;

a vessel draft depth determination module, which is used to determine the vessel's draft depth based on scale characters and waterline position;

if so, determining the vessel's draft depth using a first draft depth calculation formula based on the first available scale, the distance between the first available scale and the water surface, and the character height;

if not, determining whether the available scales include a second available scale and a third available scale;

if the third available scale is not included in the available scales, then based on the first available scale, the second available scale, the distance between the available scale and the water surface, and the distance between the available scales, determining the vessel's draft depth by a second draft depth calculation formula;

if the available scales include the second available scale and the third available scale, then based on the first available scale, the second available scale, the third available scale, the distance between the available scale and the water surface, and the distance between the available scales, determining the vessel's draft depth using a third draft depth calculation formula;

$$D = S_1 - \frac{\beta \cdot d}{h_1}$$

$$D = \frac{d}{d_1}(S_1 - S_2)$$

$$D = \frac{d_2 \cdot d \cdot (S_2 - S_1)}{d_1 \cdot d_1 \cdot (S_3 - S_2)}$$

wherein the first draft depth calculation formula is:

$$D = S_1 - \frac{\beta \cdot d}{h_1}$$

where, D is the vessel's draft depth, $S_1$ is the first available scale, β is the character height, d is the distance between the first available scale and the water surface, and $h_1$ is the height of the detection box corresponding to the scale;

the second draft depth calculation formula is:

$$D = \frac{d}{d_1}(S_1 - S_2)$$

where, $d_1$ is the distance between the first available scale and the second available scale, and $S_2$ is the second available scale;

the third draft depth calculation formula is:

$$D = \frac{d_2 \cdot d \cdot (S_2 - S_1)}{d_1 \cdot d_1 \cdot (S_3 - S_2)}$$

where, $d_2$ is the distance between the second available scale and the third available scale, $S_3$ and is the third available scale.

Compared with the prior art, the beneficial effects of this disclosure are: through image processing of a vessel hull image, image blocks in local area with ship draft scale are extracted separately to improve the pertinence of data processing and reduce the complexity of data processing; based on multi-task learning network model, the image blocks in the local area are processed, the scale characters and the position of the draft line are extracted, and the computational complexity of the model is reduced. Finally, according to the relative position of the scale and the draft line, the draft depth of the ship is determined, and the automatic acquisition of the draft depth of the ship is realized, which greatly improves the efficiency of reading the draft depth of the vessel.

BRIEF DESCRIPTION OF THE DRAWINGS

Accompanying drawings are for providing further understanding of embodiments of the disclosure. The drawings form a part of the disclosure and are for illustrating the principle of the embodiments of the disclosure along with the literal description. Apparently, the drawings in the description below are merely some embodiments of the disclosure, a person skilled in the art can obtain other drawings according to these drawings without creative efforts. In the figures.

DETAILED DESCRIPTION OF PREFERRED EMBODIMENTS

The technical solutions in the embodiments of the application will be described clearly and completely in combination with the drawings in the embodiments of the application.

With the continuous expansion of China's maritime demand, inland river transportation has become one of the mainstream channels of trade, and the requirements for the supervision efficiency of water transportation system are also increasing. In daily supervision, the draft depth of vessels is an important object monitored by the maritime department.

For the issue of how to detect the draft depth of vessels, there are detection methods based on acoustic signals and visual images. Among them, draft depth detection method based on acoustic signals is to install the acoustic signal transmitters and receivers on both sides of the channel, use the reception of the acoustic signal, and combine the current water surface height to determine the vessel's draft depth. The equipment deployment cost is high and requires manual reading of water surface height. The deployment of equipment based on visual images is simpler, but it often requires manual reading. Currently, existing automatic reading methods based on visual images require high accuracy in water gauge scale recognition and waterline detection, and are affected by vessel fouling.

Therefore, in the process of obtaining vessel draft depth in existing technologies, there is a problem of relying too much on manual labor, resulting in low reading efficiency.

The purpose of this disclosure is to provide a method and device for automatic detection of vessel draft depth to solve the problem of low reading efficiency caused by excessive reliance on manual labor in the process of obtaining ship draft in existing technologies.

Figure 1:
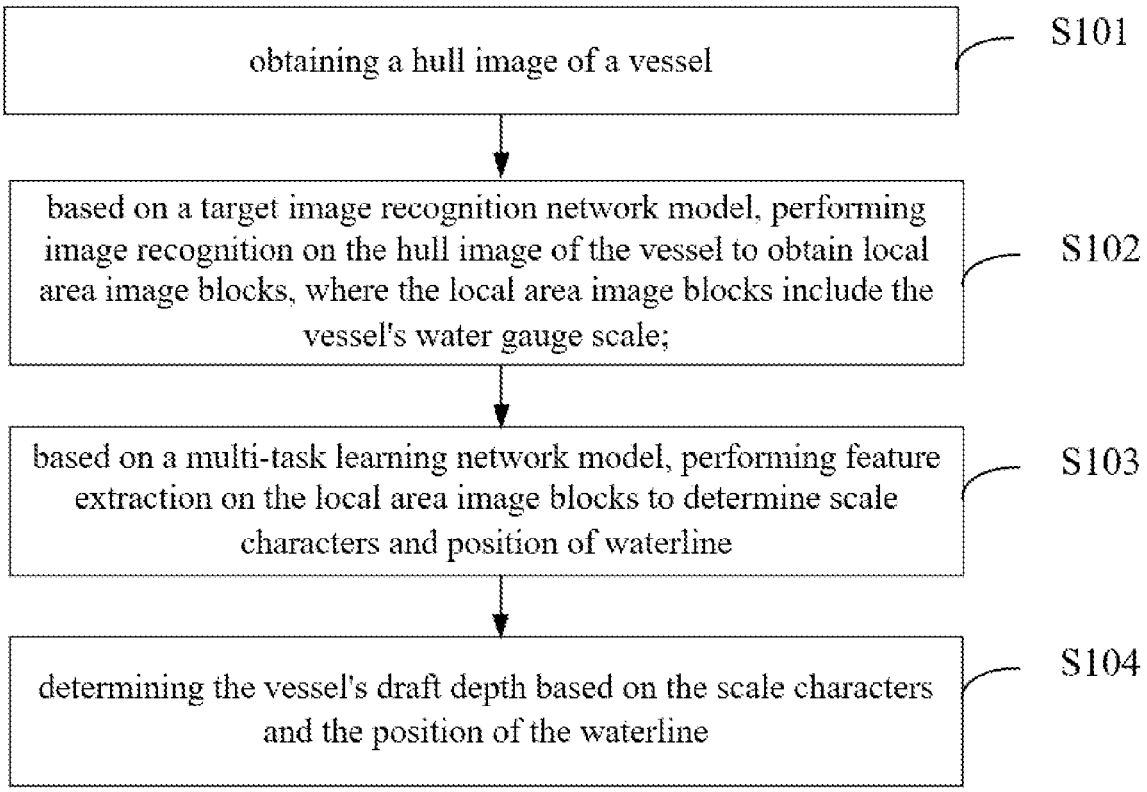
FIG. 1 is a flowchart of an embodiment of the automatic detection method for vessel draft depth provided by this disclosure.

FIG. 1 is a flowchart of an embodiment of the automatic detection method for vessel draft depth provided by this disclosure. As shown in FIG. 1, the method for automatic detection of vessel draft depth comprising:

Step S101: obtaining a hull image of a vessel;

Step S102: based on a target image recognition network model, performing image recognition on the hull image of the vessel to obtain local area image blocks, where the local area image blocks include the vessel's water gauge scale;

Step S103: based on a multi-task learning network model, performing feature extraction on the local area image blocks to determine scale characters and position of waterline;

Step S104: determining the vessel's draft depth based on the scale characters and the position of the waterline.

In this embodiment, firstly, obtaining a hull image of a vessel; then, based on a target image recognition network model, performing image recognition on the hull image of the vessel to obtain local area image blocks, where the local area image blocks include the vessel's water gauge scale; next, based on a multi-task learning network model, performing feature extraction on the local area image blocks to determine scale characters and position of waterline; finally, determining the vessel's draft depth based on the scale characters and the position of the waterline.

In this embodiment, by performing image processing on the hull image of the vessel, the local area image blocks with the vessel water gauge scale are extracted separately to improve the pertinence of data processing and reduce the complexity of data processing; and based on a multi-task learning network model, performing data processing on the local area image blocks to extract scale characters and waterline position, thereby determining the vessel's draft depth. This can automatically obtain the vessel's draft depth, greatly improving the efficiency of reading the vessel's draft depth.

As a preferred embodiment, in step S101, in order to obtain the hull image of the vessel, a camera device is used to capture an image of the inland river vessel's hull, and then the obtained images are adaptively filtered for use.

Figure 2:
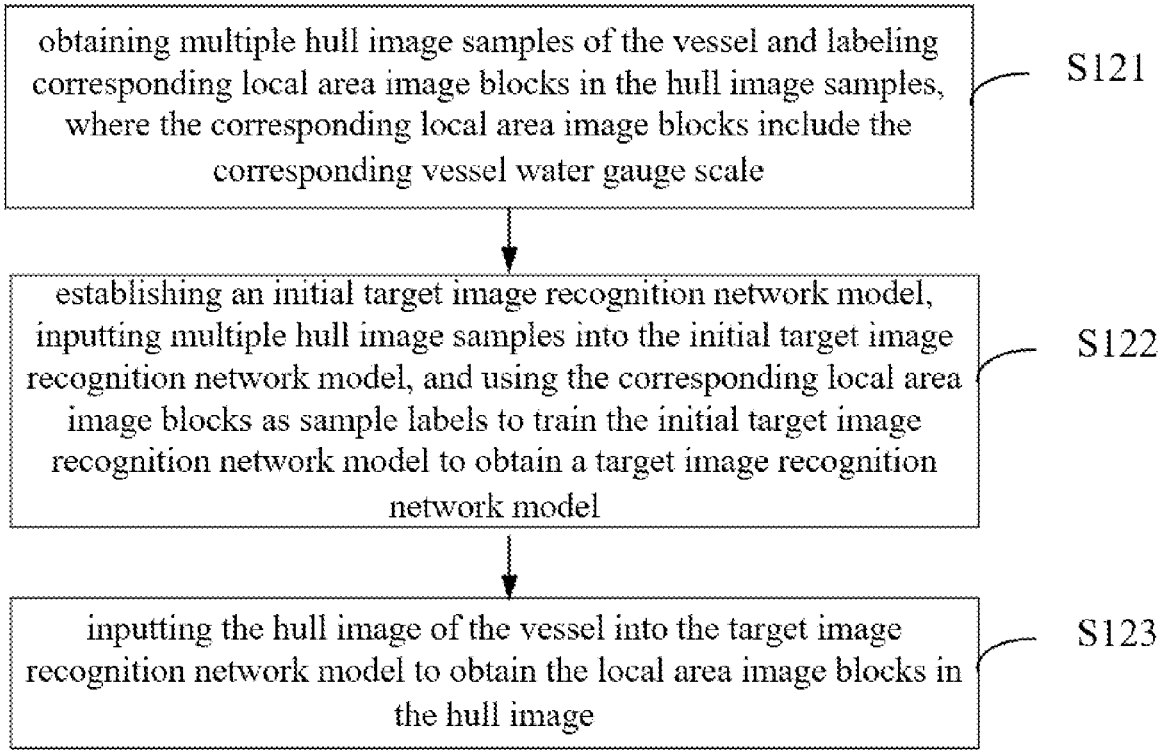
FIG. 2 is a flowchart of an embodiment of obtaining local area image blocks provided by this disclosure.

As a preferred embodiment, in step S102, in order to obtain local area image blocks, as shown in FIG. 2, FIG. 2 is a flowchart of an embodiment provided by this disclosure for obtaining local area image blocks. The method to obtain local area image blocks comprises:

Step S121: obtaining multiple hull image samples of the vessel and labeling corresponding local area image blocks in the hull image samples, where the corresponding local area image blocks include the corresponding vessel water gauge scale;

Step S122: establishing an initial target image recognition network model, inputting multiple hull image samples into the initial target image recognition network model, and using the corresponding local area image blocks as sample labels to train the initial target image recognition network model to obtain a target image recognition network model;

Step S123: inputting the hull image of the vessel into the target image recognition network model to obtain the local area image blocks in the hull image.

In this embodiment, firstly, obtaining multiple hull image samples of the vessel and labeling corresponding local area image blocks in the hull image samples, where the corresponding local area image blocks include the corresponding vessel water gauge scale; then, establishing an initial target image recognition network model, inputting multiple hull image samples into the initial target image recognition network model, and using the corresponding local area image blocks as sample labels to train the initial target image recognition network model to obtain a target image recognition network model; and finally, inputting the hull image of the vessel into the target image recognition network model to obtain the local area image blocks in the hull image.

In this embodiment, the target image recognition network model is used to process the hull image of the vessel, which can automatically capture and output local area image blocks that includes the vessel's water gauge scale, thereby effectively improving the efficiency of obtaining local area image blocks for targeted data processing afterwards, and reducing the amount and complexity of data processing.

It should be noted that in step S121, the local area image block is a part of the vessel's hull image, and the border of the local area image block is rectangular.

In a specific embodiment, when the vessel's water gauge scale cannot be detected in the vessel's hull image sample, the sample is discarded.

As a preferred embodiment, in step S122, the initial target image recognition network model is the YOLOv7 network model.

That is, in this implementation, the existing YOLOv7 network model is used to obtain a target image recognition network model that meets the requirements by adaptively adjusting the operating parameters.

Figure 3:
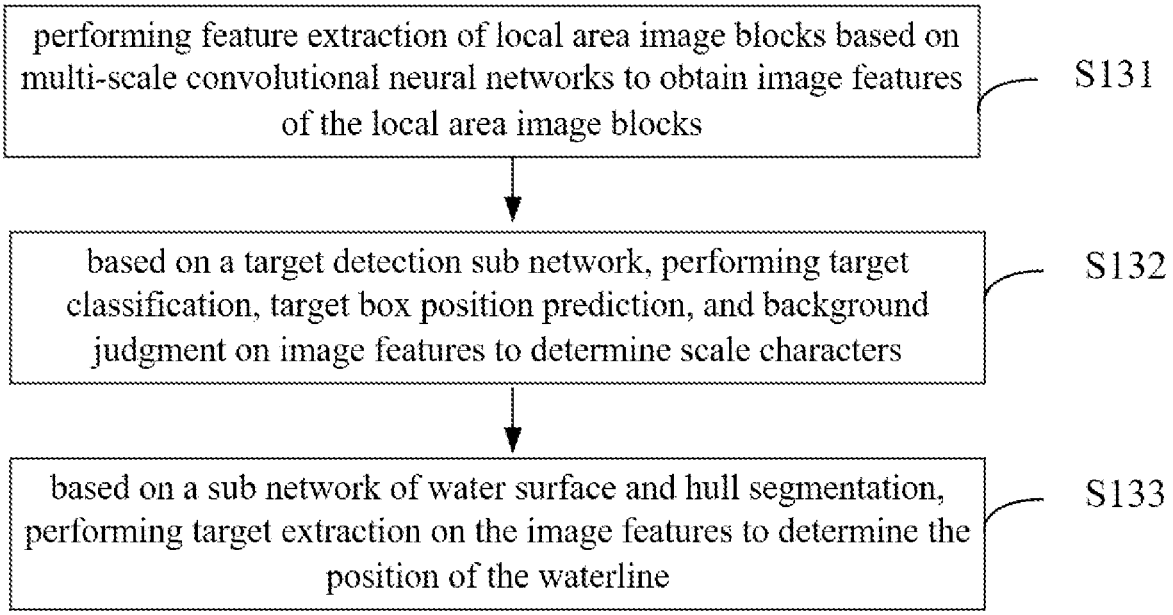
FIG. 3 is a flowchart of an embodiment of determining the position of scale characters and waterlines provided by this disclosure.

As a preferred embodiment, in step S103, the multi-task learning network model includes a multi-scale convolutional neural network, a target detection sub network, and a water surface and vessel hull segmentation sub network; In order to determine the scale characters and the position of waterline, as shown in FIG. 3, FIG. 3 is a flowchart of an embodiment of determining the scale characters and the position of waterline provided by this disclosure. Determining the scale characters and the position of waterline includes:

Step S131: performing feature extraction of local area image blocks based on multi-scale convolutional neural networks to obtain image features of the local area image blocks;

Step S132: based on a target detection sub network, performing target classification, target box position prediction, and background judgment on image features to determine scale characters;

Step S133: based on a sub network of water surface and hull segmentation, performing target extraction on the image features to determine the position of the waterline.

In this embodiment, firstly, performing feature extraction of local area image blocks based on multi-scale convolutional neural networks to obtain image features of the local area image blocks; then, based on a target detection sub network, performing target classification, target box position prediction, and background judgment on image features to determine scale characters; finally, based on a sub network of water surface and hull segmentation, performing target extraction on the image features to determine the position of the waterline.

In this embodiment, a multi-scale convolutional neural network is used to extract features from local area image blocks, achieving automatic acquisition of image features; furthermore, the scale characters in the image features are obtained through the target detection sub network, and the waterline position in the image features is obtained through the water surface and hull segmentation sub network, which can automatically obtain the scale characters and waterline position in the local area image blocks.

As a preferred embodiment, in step S131, the multi-scale convolutional neural network includes multiple convolutional blocks, wherein each convolutional block is composed of a convolutional layer, a normalization layer, and an activation function layer. In order to obtain the image features of local area image blocks, first, the convolutional layer downsampling the local area image blocks. Each convolutional layer is followed by a normalization layer, which is followed by an activation function. By downsampling multiple times, the image features of local area image blocks are obtained.

In a specific embodiment, in order to extract feature information at different scales, a convolutional layer with a step size of 2, 3*3 convolutional kernels is used for image downsampling. Each convolutional layer is followed by a normalization layer, which is followed by a SiLU activation function. The SiLU activation function can be represented as:

$$Y=X\cdot\text{signoid}(X)$$

Among them, X represents an input, Y represents an output, and sigmoid(·) is the logistic function, which is used to increase the nonlinear representation ability of the convolutional layer.

In a specific embodiment, multiple feature maps at multiple scales are obtained after multiple downsampling.

As a preferred embodiment, in step S132, the target detection sub network includes a multi-scale convolutional layer and multiple decoupled detection head branches. To determine the scale characters, first, a portion of the feature map is input to the target detection sub network for residual connection. Through multi-scale convolutional layer processing, multiple decoupled detection head branches output target classification, target box position prediction, and background judgment respectively. Then, based on target classification, target box position prediction, and background judgment, determining the scale characters.

In a specific embodiment, performing water gauge character association based on the detection results of the water gauge scale characters output by the target detection sub network to achieve water gauge scale recognition and positioning, specifically:

Firstly, traversing all detection results. As there is no overlap in the water gauge characters, for multiple detection boxes with an overlap of more than 30%, only the detection box with the highest reliability is retained.

Then, correlating detection results of horizontally adjacent characters with a vertical height difference less than one-third of their own box size, and concatenating the corresponding target detection boxes to form the corresponding water gauge scale reading and detection box position. Deleting detection results that are not combined with other characters.

By associating the water gauge characters, all scale values and their positions in the local area image blocks can be obtained.

Furthermore, according to the standard for surveying and mapping water gauges of inland vessels, revising the result of water gauge calibration recognition, specifically as follows:

Setting the distance between the water gauge scales of inland vessels to 0.2 meters.

Therefore, based on the above scale recognition results, the first step is to score and determine that a scale with a difference of no more than 0.2 from adjacent scales is a false check scale. Then using the correct scale to predict the correct scale corresponding to the position of the false check scale which can be expressed as:

$$N_i=\varphi\left(N_1-\frac{d_2(N_1-N_2)}{d_1}\right)$$

where, $N_i$ represents the current predicted scale value, $\varphi(x)$ is a functional function used to find the nearest integer multiple of 0.2 to x, and cannot overlap with the current recognition scale results, $N_1$ and $N_2$ are the two correct scales closest to $N_i$, respectively, $d_1$ is the vertical distances between $N_1$ and $N_2$, $d_2$ is the vertical distances between $N_1$ and $N_i$. When the scale is located below the $N_i$ scale, $d_2$ should be a negative number.

As a preferred embodiment, in step S133, the water surface and hull segmentation sub network includes multiple upsampling convolutional blocks, which are concatenated with multiple feature maps extracted by the multi-scale convolutional neural network to achieve residual connection and target extraction. Finally, a feature map of the same size as the original image is output, and the waterline position is determined based on the classification results of each pixel on the feature map.

In a specific embodiment, the water surface and hull segmentation sub network is a U-Net structure.

In the process of training a multi-task learning network model, a joint loss function is set to reverse control the training results. The joint loss function includes the loss function of the target detection task and the loss function of the segmentation task. The joint loss function can be expressed as:

$$L_{all}=a_1L_{det}+\alpha_2L_{seg}$$

where, $L_{all}$ is the joint loss function, $L_{det}$ is the loss function of the target detection task, $L_{seg}$ is the loss function of the segmentation task, $\alpha_1$ is the weight of the loss function of $L_{det}$, $\alpha_2$ is the weight of the loss function of $L_{seg}$.

In a specific embodiment, the value of $\alpha_1$ is 1 and the value of $\alpha_2$ is 100.

Furthermore, the loss function $L_{det}$ of the target detection task can be expressed as:

$$L_{det}=\beta_1 L_{cls}+\beta_2 L_{reg}+\beta_3 L_{iou}$$

where, $L_{cls}$ is the cross entropy loss of the classification task, $L_{reg}$ is the cross entropy loss of the background judgment task, $L_{iou}$ is the overlap degree of the detection box and label, and $\beta_1$, $\beta_2$, and $\beta_3$ are the corresponding loss weights.

The overlap degree IoU can be expressed as:

$$IoU = \frac{P \cap L}{P \cup L}$$

where, P and L are prediction boxes and label annotation boxes, respectively.

The loss of segmentation tasks can be expressed as:

$$L_{seg}=L_{ce}+L_{dice}$$

where, $L_{ce}$ is the cross entropy loss between the predicted value and the label, and $L_{dice}$ is the set similarity loss.

Figure 4:
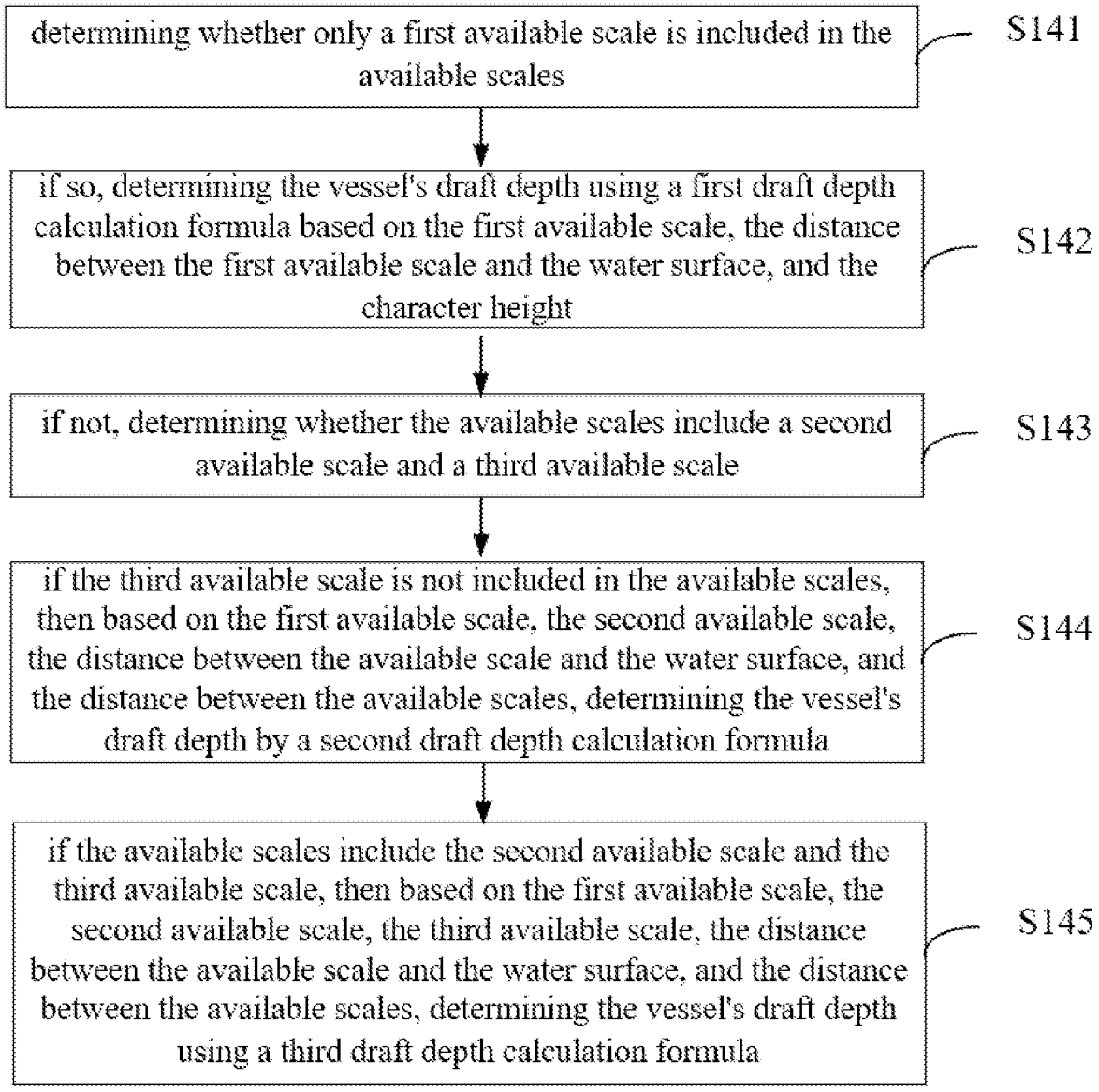
FIG. 4 is a flowchart of an embodiment of determining the draft depth of a vessel provided by this disclosure.

As a preferred embodiment, in step S104, the scale characters include available scales, distance between available scales and water surface, available scale spacing, and character height; In order to determine the draft depth of a vessel, as shown in FIG. 4, FIG. 4 is a flowchart of an embodiment of determining the draft depth of a vessel provided by this disclosure. The determination of the draft depth of a vessel includes:

Step S141: determining whether only a first available scale is included in the available scales;

Step S142: if so, determining the vessel's draft depth using a first draft depth calculation formula based on the first available scale, the distance between the first available scale and the water surface, and the character height;

Step S143: if not, determining whether the available scales include a second available scale and a third available scale;

Step S144: if the third available scale is not included in the available scales, then based on the first available scale, the second available scale, the distance between the available scale and the water surface, and the distance between the available scales, determining the vessel's draft depth by a second draft depth calculation formula;

Step S145: if the available scales include the second available scale and the third available scale, then based on the first available scale, the second available scale, the third available scale, the distance between the available scale and the water surface, and the distance between the available scales, determining the vessel's draft depth using a third draft depth calculation formula.

In this embodiment, performing adaptive grouping based on the number of available scales to achieve multiple methods of determining the vessel's draft. It is evident that when there is only one available scale, the vessel's draft depth can also be determined based on the distance between the available scale and the water surface and the character height in this embodiment. That is to say, it can better adapt to the situation where the scale is covered or stained.

As a preferred embodiment, in step S142, the first draft depth calculation formula is:

$$D = S_1 - \frac{\beta \cdot d}{h_1}$$

where, D is the vessel's draft depth, $S_1$ is the first available scale, $\beta$ is the character height, d is the distance between the first available scale and the water surface, and $h_1$ is the height of the detection box corresponding to the scale.

It should be noted that the value of $\beta$ is 0.1, $h_1$ is set in advance based on the device parameters.

It should be noted that in step S143, when the available scales are not a unique value, the purpose of determining whether to include the second available scale and third available scale is to determine whether there is a third available scale and select an appropriate calculation method.

As a preferred embodiment, in step S144, the second draft depth calculation formula is:

$$D = \frac{d}{d_1}(S_1 - S_2)$$

where, $d_1$ is the distance between the first available scale and the second available scale, and $S_2$ is the second available scale.

As a preferred embodiment, in step S145, the third draft depth calculation formula is:

$$D = \frac{d_2 \cdot d \cdot (S_2 - S_1)}{d_1 \cdot d_1 \cdot (S_3 - S_2)}$$

where, $d_2$ is the distance between the second available scale and the third available scale, $S_3$ and is the third available scale.

By using the above formulas, it is possible to determine the draft depth when any available scale is known, combined with the relevant regulations of the vessel itself.

Figure 5:
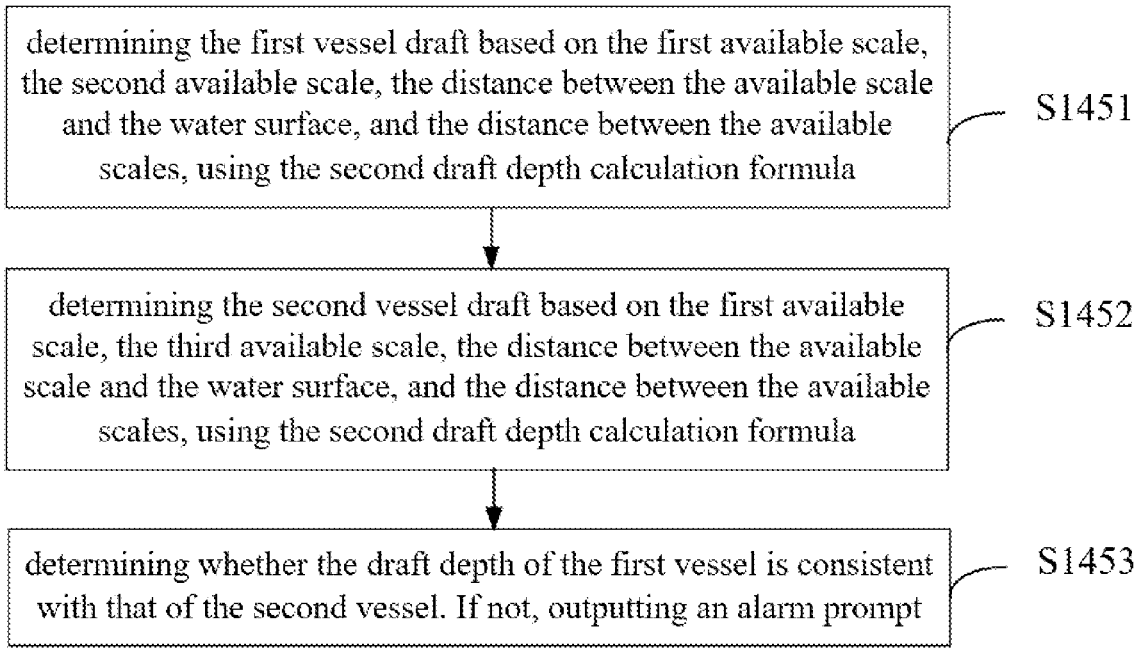
FIG. 5 is a flowchart illustrating an embodiment of the accuracy of inspecting the draft depth of a vessel provided by this disclosure.

Furthermore, in order to improve the reliability of the vessel's draft depth, the accuracy of the vessel's draft depth can also be checked, as shown in FIG. 5. FIG. 5 is a flowchart of an embodiment provided by this disclosure for checking the accuracy of the vessel's draft depth. The accuracy of checking the vessel's draft depth includes:

Step S1451: determining the first vessel draft based on the first available scale, the second available scale, the distance between the available scale and the water surface, and the distance between the available scales, using the second draft depth calculation formula;

Step S1452: determining the second vessel draft based on the first available scale, the third available scale, the distance between the available scale and the water surface, and the distance between the available scales, using the second draft depth calculation formula;

Step S1453: determining whether the draft depth of the first vessel is consistent with that of the second vessel. If not, outputting an alarm prompt.

In this embodiment, the third available scale is used as the second available scale for calculation. Based on the second draft calculation formula, determining the first vessel draft depth and the second vessel draft depth accordingly, and then comparing the two values to determine whether they are consistent, in order to determine whether the current obtained vessel draft depth is accurate and reliable.

It should be noted that in this embodiment, random adjustments can also be made to the first available scale, second available scale, and third available scale during the calculation process.

In other embodiments, it is also possible to verify whether the vessel's draft depth obtained from character height meets the accuracy requirements. That is, after obtaining the vessel's draft depth, the difference between the two endpoints of the character is calculated using the same method to ensure that it meets the expectations, in order to avoid the problem of deviation in the obtained vessel's draft depth due to angle deviation during image shooting.

Through the above method, firstly, carrying out image processing on the vessel hull image, and the local area image blocks with the vessel's water gauge scale are separately extracted to improve the pertinence of data processing and reduce the complexity of data processing; Then, based on a multi-task learning network model, performing data processing on local area image blocks to extract scale characters and waterline positions, thereby determining the vessel's draft depth. Due to the fact that in the process of determining the vessel's draft depth through a multi-task learning network model in this application, the target detection sub network and the water surface and vessel hull segmentation sub network jointly use the image features captured by a multi-scale convolutional neural network, thereby reducing the computational complexity of the model. Based on the number of final available scales, the formula for determining the vessel's draft depth can be flexibly selected, which can improve the accuracy of the vessel's draft depth. Therefore, this disclosure can not only automatically obtain the vessel's draft depth, greatly improving the efficiency of reading the vessel's draft depth, but also improving the accuracy of reading the vessel's draft depth.

Figure 6:
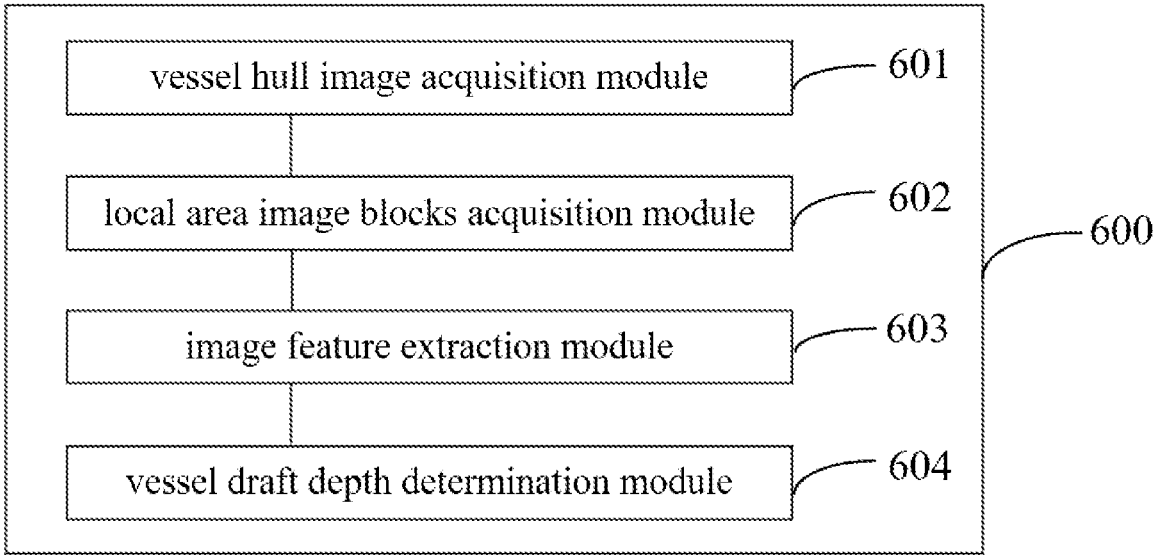
FIG. 6 is a structural block diagram of an embodiment of an automatic detection device for vessel draft depth provided by this disclosure.

This disclosure also provides an automatic detection device for vessel draft depth, as shown in FIG. 6. FIG. 6 is a structural diagram of an embodiment of the automatic detection device for vessel draft depth provided by this disclosure. The automatic detection device 600 for vessel draft depth comprises:

- a vessel hull image acquisition module 601, which is used for obtaining a vessel hull image;
- a local area image blocks acquisition module 602, which is used for image recognition of a vessel hull image based on a target image recognition network model to obtain local area image blocks, wherein the local area image blocks include the vessel water gauge scale of the vessel hull image;
- an image feature extraction module 603, which is used for feature extraction of local area image blocks based on a multi-task learning network model, determining scale characters and waterline position;
- a vessel draft depth determination module 604, which is used to determine the vessel's draft depth based on scale characters and waterline position.

Figure 7:
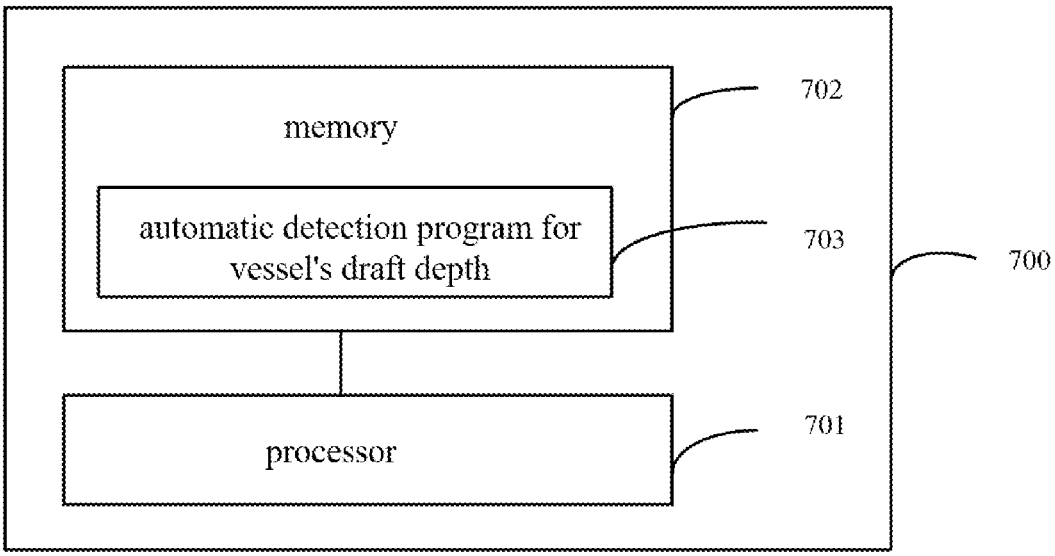
FIG. 7 is a structural diagram of an embodiment of the electronic device provided by this disclosure.

This disclosure also provides an electronic device, as shown in FIG. 7, which is a structural block diagram of an embodiment of the electronic device provided by this disclosure. The electronic device 700 can be a computing device such as a mobile terminal, a desktop computer, a laptop, a handheld computer, and a server. The electronic device 700 includes a processor 701 and a memory 702, wherein the memory 702 stores an automatic detection program 703 for the vessel's draft depth.

The memory 702 can be an internal storage unit of a computer device, such as a hard disk or memory, in some embodiments. In other embodiments, the memory 702 can also be an external storage device of a computer device, such as a plug-in hard disk, a Smart Media Card (SMC), a Secure Digital (SD) card, a Flash Card, etc. provided on the computer device. Furthermore, the memory 702 can also include both internal storage units of computer devices and external storage devices. The memory 702 is used to store application software and various types of data installed on a computer device, such as program codes for installing computer devices. The memory 702 can also be used to temporarily store data that has been or will be output. In one embodiment, the automatic detection program 703 of the vessel's draft depth can be executed by the processor 701, thereby realizing the automatic detection method of the vessel's draft depth in each embodiment of this disclosure.

In some embodiments, the processor 701 may be a Central Processing Unit (CPU), a microprocessor, or other data processing chip used to run program code stored in the memory 702 or process data, such as executing automatic detection programs for vessel draft depth.

This embodiment also provides a computer-readable storage medium on which an automatic detection program for vessel draft depth is stored. When the program is executed by the processor, the automatic detection method for vessel draft depth as described in any of the above technical solutions is implemented.

Ordinary technical personnel in this field can understand that implementing all or part of the processes in the above embodiments can be completed by instructing the relevant hardware through a computer program. The computer program can be stored in a non-volatile computer readable storage medium, and when executed, the computer program can include processes in embodiments of the above methods. Any reference to memory, storage, database, or other media used in the embodiments provided in this application may include non-volatile and/or volatile memory. Non-volatile memory can include read-only memory (ROM), programmable ROM (PROM), electrically programmable ROM (EPROM), electrically erasable programmable ROM (EEPROM), or flash memory. Volatile memory can include random access memory (RAM) or external cache memory. As an explanation rather than limitation, RAM is available in various forms, such as static RAM (SRAM), dynamic RAM (DRAM), synchronous DRAM (SDRAM), dual data rate SDRAM (DDRSDRAM), enhanced SDRAM (ESDRAM), synchronous link DRAM (SLDRAM), Rambus direct RAM (RDRAM), direct memory bus dynamic RAM (DRDRAM), and memory bus dynamic RAM (RDRAM).

It is to be understood, however, that even though numerous characteristics and advantages of this disclosure have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A method for automatic detection of vessel draft depth, comprising:

obtaining a hull image of a vessel;

based on a target image recognition network model, performing image recognition on the hull image of the vessel to obtain local area image blocks, where the local area image blocks include the vessel's water gauge scale;

constructing a multi-task learning network model, the multi-task learning network model includes a multi-scale convolutional neural network, a target detection sub network, and a water surface and vessel hull segmentation sub network;

performing feature extraction of local area image blocks based on multi-scale convolutional neural networks to obtain image features of the local area image blocks;

based on the target detection sub network, performing target classification, target box position prediction, and background judgment on image features to determine scale characters;

based on a sub network of water surface and hull segmentation, performing target extraction on the image features to determine the position of the waterline;

determining whether only a first available scale is included in the available scales;

if so, determining the vessel's draft depth using a first draft depth calculation formula based on the first available scale, the distance between the first available scale and the water surface, and the character height;

if not, determining whether the available scales include a second available scale and a third available scale;

if the third available scale is not included in the available scales, then based on the first available scale, the second available scale, the distance between the available scale and the water surface, and the distance between the available scales, determining the vessel's draft depth by a second draft depth calculation formula;

if the available scales include the second available scale and the third available scale, then based on the first available scale, the second available scale, the third available scale, the distance between the available scale and the water surface, and the distance between the available scales, determining the vessel's draft depth using a third draft depth calculation formula;

wherein the first draft depth calculation formula is:

$$D = S_1 - \frac{\beta \cdot d}{h_1}$$

where, D is the vessel's draft depth, $S_1$ is the first available scale, β is the character height, d is the distance between the first available scale and the water surface, and II is the height of the detection box corresponding to the scale;

the second draft depth calculation formula is:

$$D = \frac{d}{d_1}(S_1 - S_2)$$

where, $d_1$ is the distance between the first available scale and the second available scale, and $S_2$ is the second available scale;

the third draft depth calculation formula is:

$$D = \frac{d_2 \cdot d \cdot (S_2 - S_1)}{d_1 \cdot d_1 \cdot (S_3 - S_2)}$$

where, $d_2$ is the distance between the second available scale and the third available scale, $S_3$ and is the third available scale.

2. The method for automatic detection of vessel draft depth according to claim 1, further comprising obtaining multiple hull image samples of the vessel and labeling corresponding local area image blocks in the hull image samples, where the corresponding local area image blocks include the corresponding vessel water gauge scale;

establishing an initial target image recognition network model, inputting multiple hull image samples into the initial target image recognition network model, and using the corresponding local area image blocks as sample labels to train the initial target image recognition network model to obtain a target image recognition network model; and inputting the hull image of the vessel into the target image recognition network model to obtain the local area image blocks in the hull image.

3. The method for automatic detection of vessel draft depth according to claim 1, wherein the target image recognition network model is the YOLOv7 network model.

4. The method for automatic detection of vessel draft depth according to claim 1, wherein the multi-scale convolutional neural network includes multiple convolutional blocks, wherein each convolutional block is composed of a convolutional layer, a normalization layer, and an activation function layer;

performing feature extraction of local area image blocks based on multi-scale convolutional neural networks to obtain image features of the local area image blocks comprises: first, the convolutional layer downsampling the local area image blocks; each convolutional layer is followed by a normalization layer, which is followed by an activation function; and by downsampling multiple times, the image features of local area image blocks are obtained.

5. The method for automatic detection of vessel draft depth according to claim 4, wherein the image features include multiple feature maps at multiple scales;

the target detection sub network includes a multi-scale convolutional layer and multiple decoupled detection head branches;

based on a target detection sub network, performing target classification, target box position prediction, and background judgment on image features to determine scale characters, comprising:

a portion of the feature map is input to the target detection sub network for residual connection;

through multi-scale convolutional layer processing, multiple decoupled detection head branches output target classification, target box position prediction, and background judgment respectively; and based on target classification, target box position prediction, and background judgment, determining the scale characters.

6. The method for automatic detection of vessel draft depth according to claim 5, wherein the water surface and hull segmentation sub network includes multiple upsampling convolutional blocks;

based on a sub network of water surface and hull segmentation, performing target extraction on the image features to determine the position of the waterline, comprising:

concatenating multiple upsampling convolutional blocks with multiple feature maps, and performing target extraction through residual connections to determine the waterline position.

7. The method for automatic detection of vessel draft depth according to claim 1, wherein determining the vessel's draft depth includes:

determining the first vessel draft based on the first available scale, the second available scale, the distance between the available scale and the water surface, and the distance between the available scales, using the second draft depth calculation formula;

determining the second vessel draft based on the first available scale, the third available scale, the distance between the available scale and the water surface, and the distance between the available scales, using the second draft depth calculation formula;

determining whether the draft depth of the first vessel is consistent with that of the second vessel; if not, outputting an alarm prompt.

8. A device for automatic detection of vessel draft depth, comprising:

a vessel hull image acquisition module, configured to obtain vessel hull image;

a local area image blocks acquisition module, configured to perform image recognition of a vessel hull image based on a target image recognition network model to obtain local area image blocks, wherein the local area image blocks include the vessel water gauge scale of the vessel hull image;

a multi-task learning network model construction module, configured to construct a multi-task learning network model, the multi-task learning network model includes a multi-scale convolutional neural network, a target detection sub network, and a water surface and vessel hull segmentation sub network;

an image feature extraction module, configured to extract features from the local area image block based on the multi-scale convolutional neural network, and obtain image features of the local area image blocks;

a scale character determination module, configured to perform target classification, target box position prediction, and background judgment of the image features based on the target detection sub network to determine scale characters, wherein the scale characters include available scale, distance between available scale and water surface, available scale spacing, and character height;

a waterline position determination module, configured to extract targets from the image features based on the water surface and ship hull segmentation sub network, and determine the waterline position;

a vessel draft depth determination module, configured to determine whether only a first available scale is included in the available scales;

if so, determine the vessel's draft depth using a first draft depth calculation formula based on the first available scale, the distance between the first available scale and the water surface, and the character height;

if not, determine whether the available scales include a second available scale and a third available scale;

if the third available scale is not included in the available scales, then based on the first available scale, the second available scale, the distance between the available scale and the water surface, and the distance between the available scales, determine the vessel's draft depth by a second draft depth calculation formula;

if the available scales include the second available scale and the third available scale, then based on the first available scale, the second available scale, the third available scale, the distance between the available scale and the water surface, and the distance between the available scales, determine the vessel's draft depth using a third draft depth calculation formula;

$$D = S_1 - \frac{\beta \cdot d}{h_1}$$

$$D = \frac{d}{d_1}(S_1 - S_2)$$

$$D = \frac{d_2 \cdot d \cdot (S_2 - S_1)}{d_1 \cdot d_1 \cdot (S_3 - S_2)}$$

wherein the first draft depth calculation formula is:

$$D = S_1 - \frac{\beta \cdot d}{h_1}$$

where, D is the vessel's draft depth, $S_1$ is the first available scale, β is the character height, d is the distance between the first available scale and the water surface, and $h_1$ is the height of the detection box corresponding to the scale;

the second draft depth calculation formula is:

$$D = \frac{d}{d_1}(S_1 - S_2)$$

where, $d_1$ is the distance between the first available scale and the second available scale, and $S_2$ is the second available scale;

the third draft depth calculation formula is:

$$D = \frac{d_2 \cdot d \cdot (S_2 - S_1)}{d_1 \cdot d_1 \cdot (S_3 - S_2)}$$

where, $d_2$ is the distance between the second available scale and the third available scale, $S_3$ and is the third available scale.

* * * * *